US006536630B1

(12) United States Patent
Chan et al.

(10) Patent No.: US 6,536,630 B1
(45) Date of Patent: Mar. 25, 2003

(54) STRUCTURE FOR DISPENSING EMULSION

(75) Inventors: Ching-Chung Chan, 8th Fl., No. 50 Sec. 2 Ho-Pei Rd., Pei-Tun District, Taichung (TW); Kun-Lung Tseng, No. 18, Alley 24 Lane 193, Hsin-I St., Jen-Te Village, Wu-Jih Hsiang Taichung Hsien (TW); Chin-Hsiang Chen, 2nd Fl., No. 376, Chin-Hua Rd., North District, Taichung (TW); Ching-Hsuan Chan, Taichung (TW)

(73) Assignees: Living Fountain Plastic Industrial Co., Ltd., Taichung (TW); Ching-Chung Chan, Taichung (TW); Kun-Lung Tseng, Taichung (TW); Chin-Hsiang Chen, Taichung (TW); Ching Hsuan Chen, Taichung (TW)

( * ) Notice: Subject to any disclaimer, the term of this patent is extended or adjusted under 35 U.S.C. 154(b) by 0 days.

(21) Appl. No.: 10/107,129

(22) Filed: Mar. 28, 2002

(51) Int. Cl.[7] ..... B65D 37/00

(52) U.S. Cl. ..... 222/207; 222/213; 222/214; 222/321.9; 222/340

(58) Field of Search ..... 220/207, 209, 220/211, 214, 212; 222/321.7, 340, 213

(56) References Cited

U.S. PATENT DOCUMENTS 5,462,208 A * 10/1995 Stahley et al. ..... 222/209
5,664,703 A * 9/1997 O'Neill ..... 222/207

* cited by examiner

*Primary Examiner*—Philippe Derakshani
(74) *Attorney, Agent, or Firm*—Harrison & Egbert

(57) ABSTRACT

An emulsion-dispensing structure includes a housing, a collar cap, an engagement cap, a plunger, and a plastic spring. The plunger is provided with an outer threaded portion and is fitted into a connect stem such that the outer threaded portion is engaged with an inner threaded portion of the connect stem. The dispensing structure is ready to dispense the emulsion from a container at such time when the plunger juts out of the connect stem.

6 Claims, 15 Drawing Sheets

STRUCTURE FOR DISPENSING EMULSION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a dispenser, and more particularly to an emulsion dispenser.

BACKGROUND OF THE INVENTION

As shown in FIGS. 1 and 2, an emulsion dispenser of the prior art comprises a housing 10 in which a plunger 11 is disposed such that the top end of the plunger 11 juts out of a cap 12 via a hole 13, and such that the top end of the plunger 11 is fastened to a saddle head 15. The cap 12 and the saddle head 15 are engaged with each other by means of two threaded portions 16 and 17. The housing 10 is provided with a shoulder 18. Located between the shoulder 18 and the cap 12 is a container cap 19 of the emulsion container (not shown in the drawings). The plunger 11 is provided with a piston device 21. The housing 10 has a tail tube 22 which is provided therein with a down valve 23 and a dip tube 24 in contact with the emulsion held in the emulsion container.

When the saddle head 15 is pressed, the emulsion is dispensed in handy units or portions via an exit 14 of the saddle head 15. The plunger 11 is provided at the lower end with a recovery spring 25 serving to provided the plunger 11 with a recovery spring force enabling the plunger 11 to return to its original position in the housing 10 at the time when the saddle head 15 is relieved of the external force exerting thereon. With the exception of the recovery spring 25 which is made of metal, other component parts of the prior art emulsion dispenser are made of a plastic material. The metal spring 25 becomes a bottleneck in the process of recycling the discarded dispensers of the prior art. In other words, the metal spring 25 and other component parts of the prior art dispenser can not be separated in a cost-effective manner in the recycling process of the prior art dispensers.

BRIEF SUMMARY OF THE INVENTION

The primary objective of the present invention is to provide an emulsion dispenser which is free of a metal component part to facilitate the recycling of the discarded dispenser.

In keeping with the principle of the present invention, the foregoing objective of the present invention is attained by a dispensing structure comprising a housing, an engagement cap to engage the housing with an emulsion container, a plunger housed in the housing, an up valve, a down valve, and an elastic element disposed between the bottom end of the plunger and the bottom of the housing.

The features and the advantages of the present invention will be more readily understood upon a thoughtful deliberation of the following detailed description of the present invention with reference to the accompanying drawings.

DETAILED DESCRIPTION OF THE INVENTION

Figure 1:
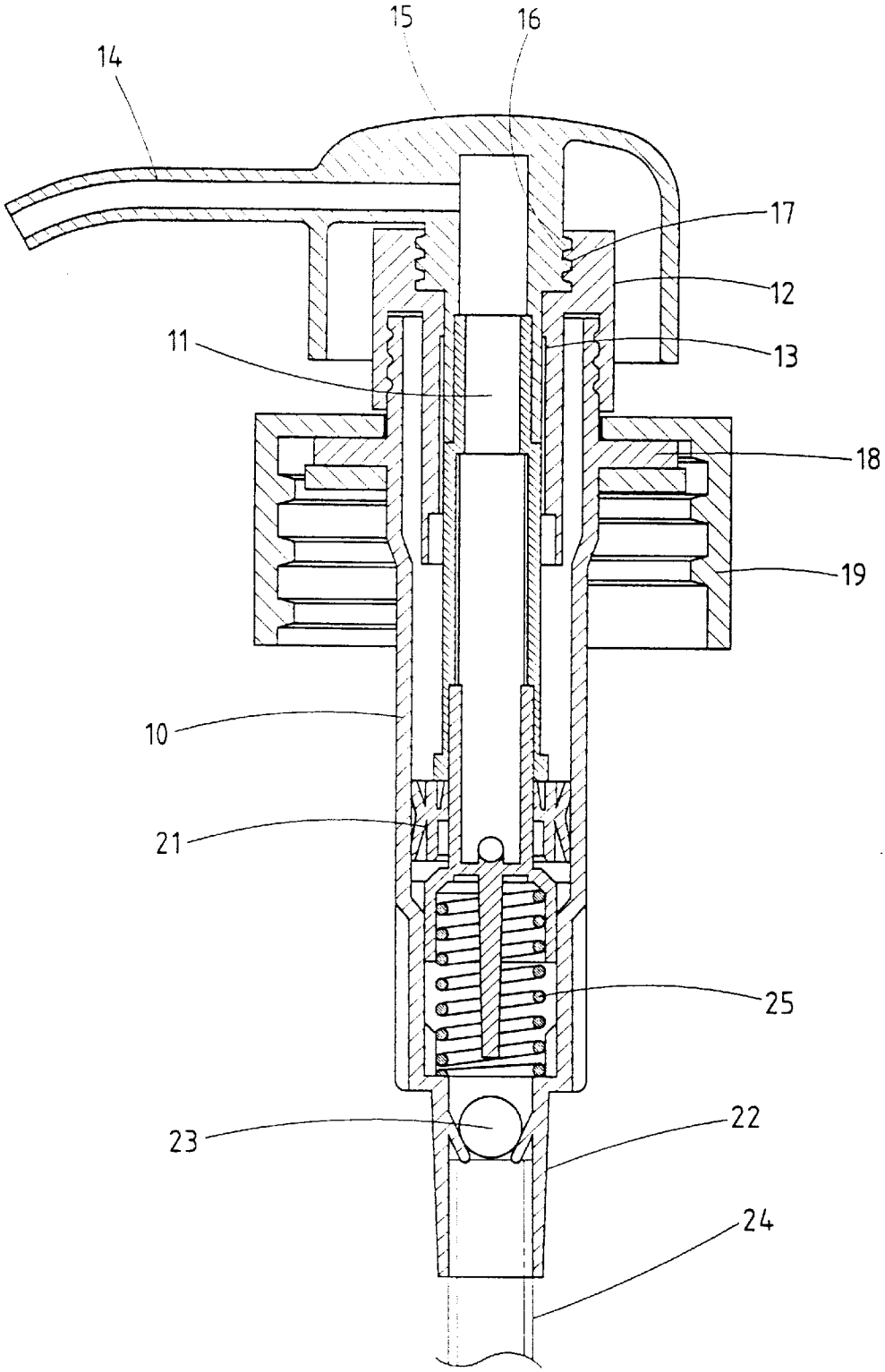
FIG.1 PRIOR ART
FIG. 1 shows a longitudinal sectional view of a prior art dispenser.
Figure 2:
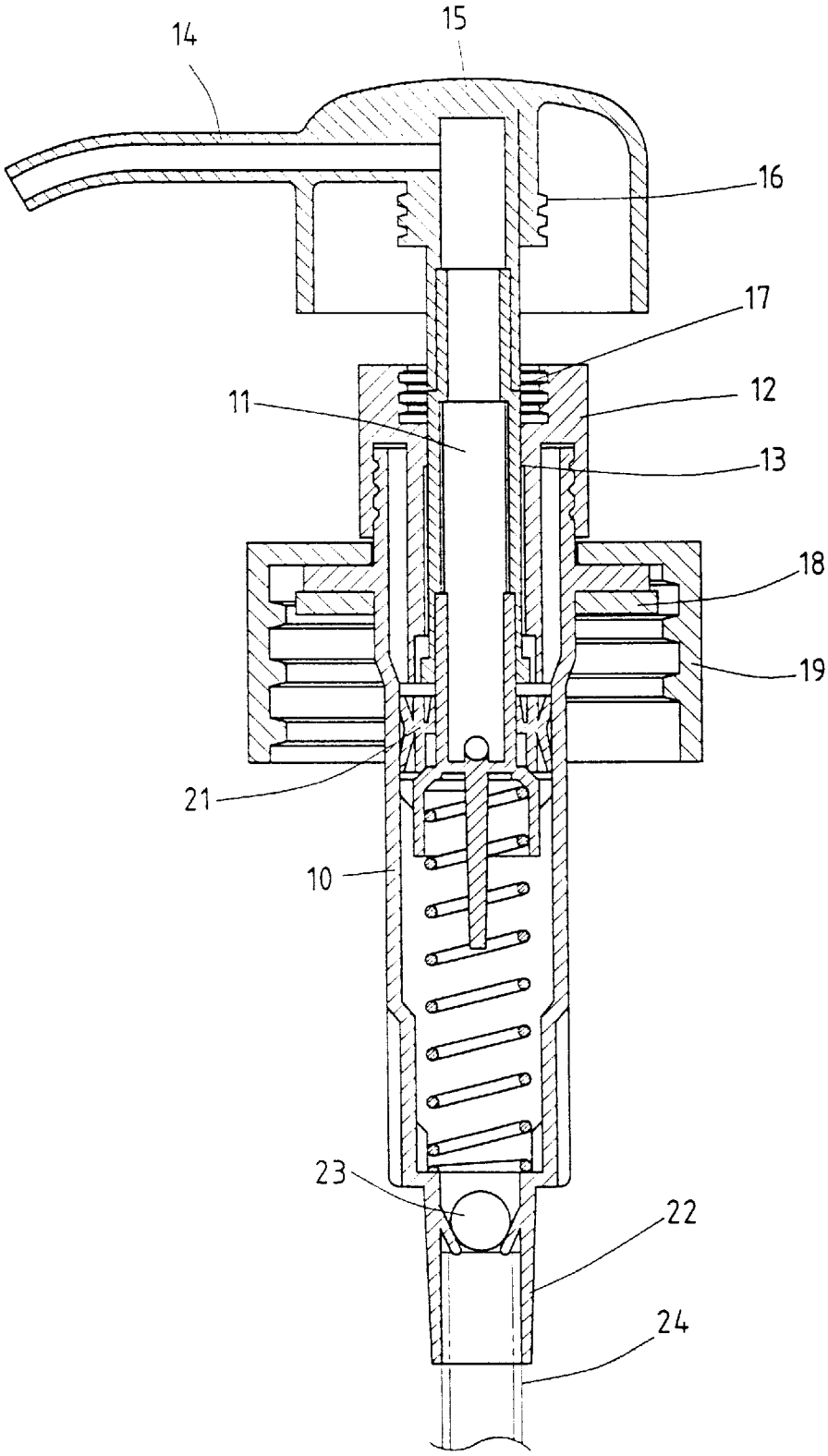
FIG.2 PRIOR ART
FIG. 2 shows a longitudinal sectional view of the prior art dispenser ready to dispense.
Figure 3:
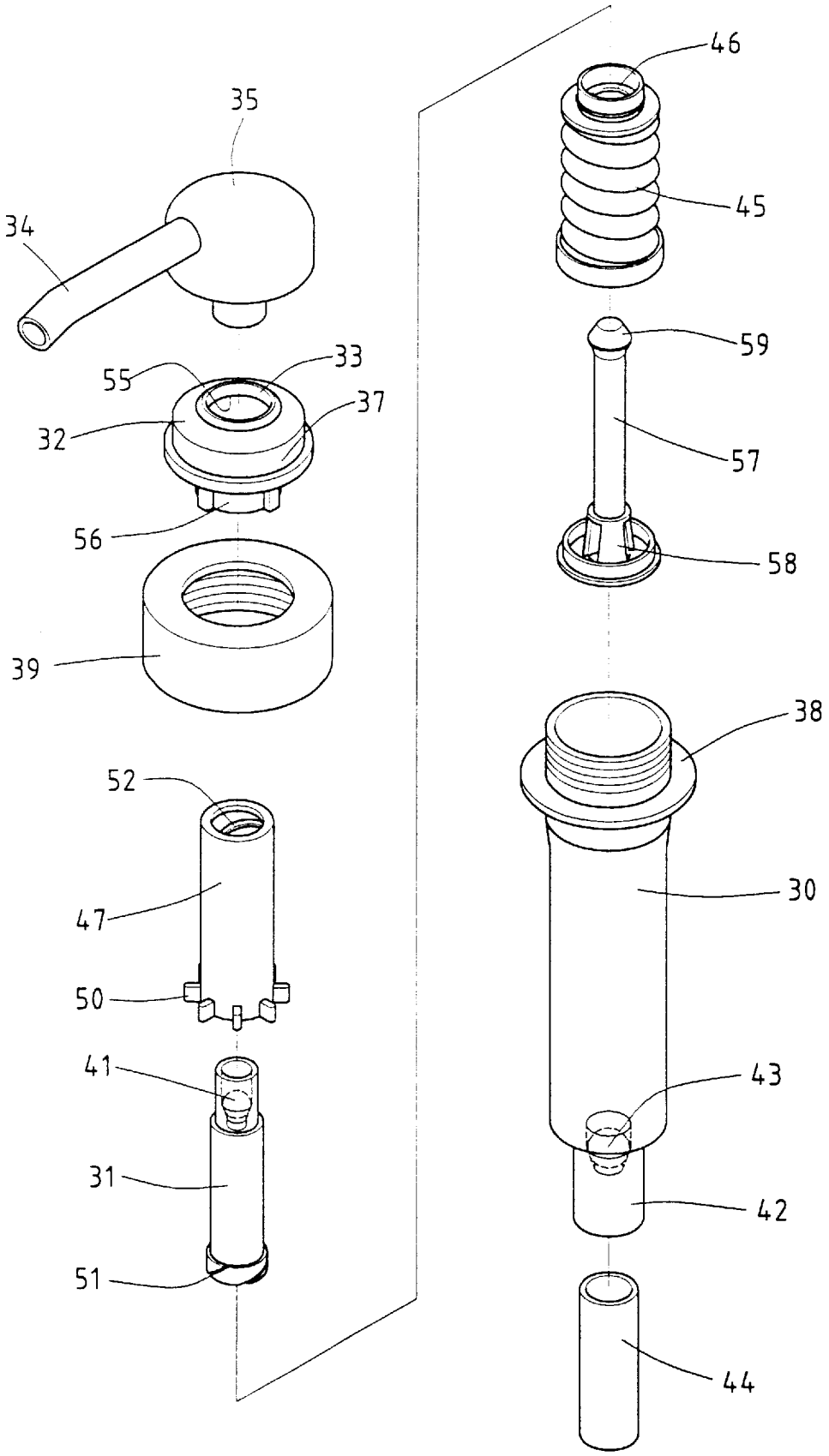
FIG. 3 shows an exploded view of an emulsion dispenser of the present invention.
Figure 4:
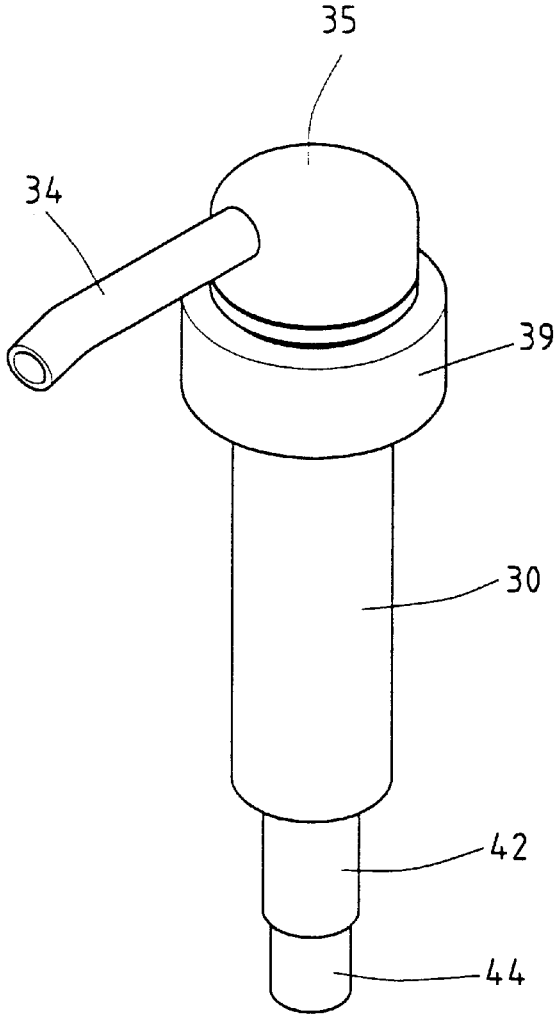
FIG. 4 shows a perspective view of the emulsion dispenser of the present invention.
Figure 5:
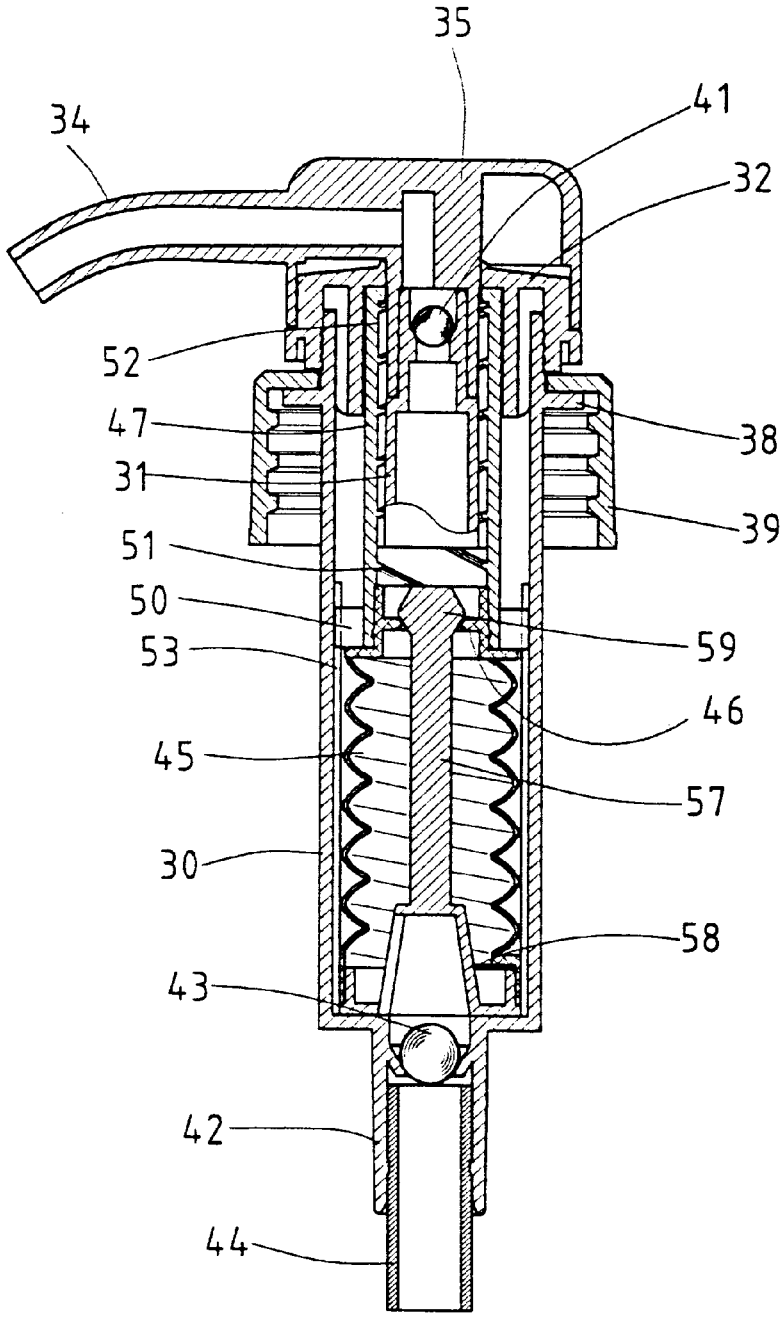
FIG. 5 shows a longitudinal sectional view of the emulsion dispenser of the present invention.
Figure 6:
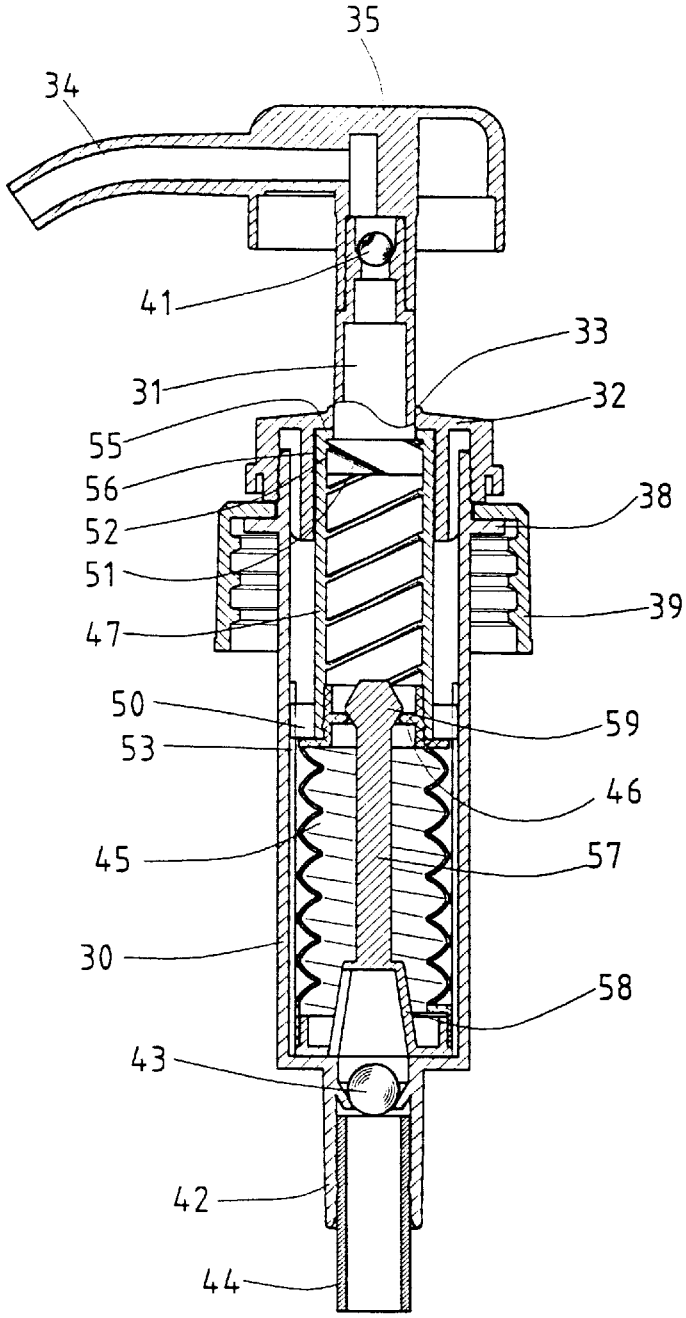
FIG. 6 shows a longitudinal sectional view of the emulsion dispenser of the present invention ready to dispense.
Figure 7:
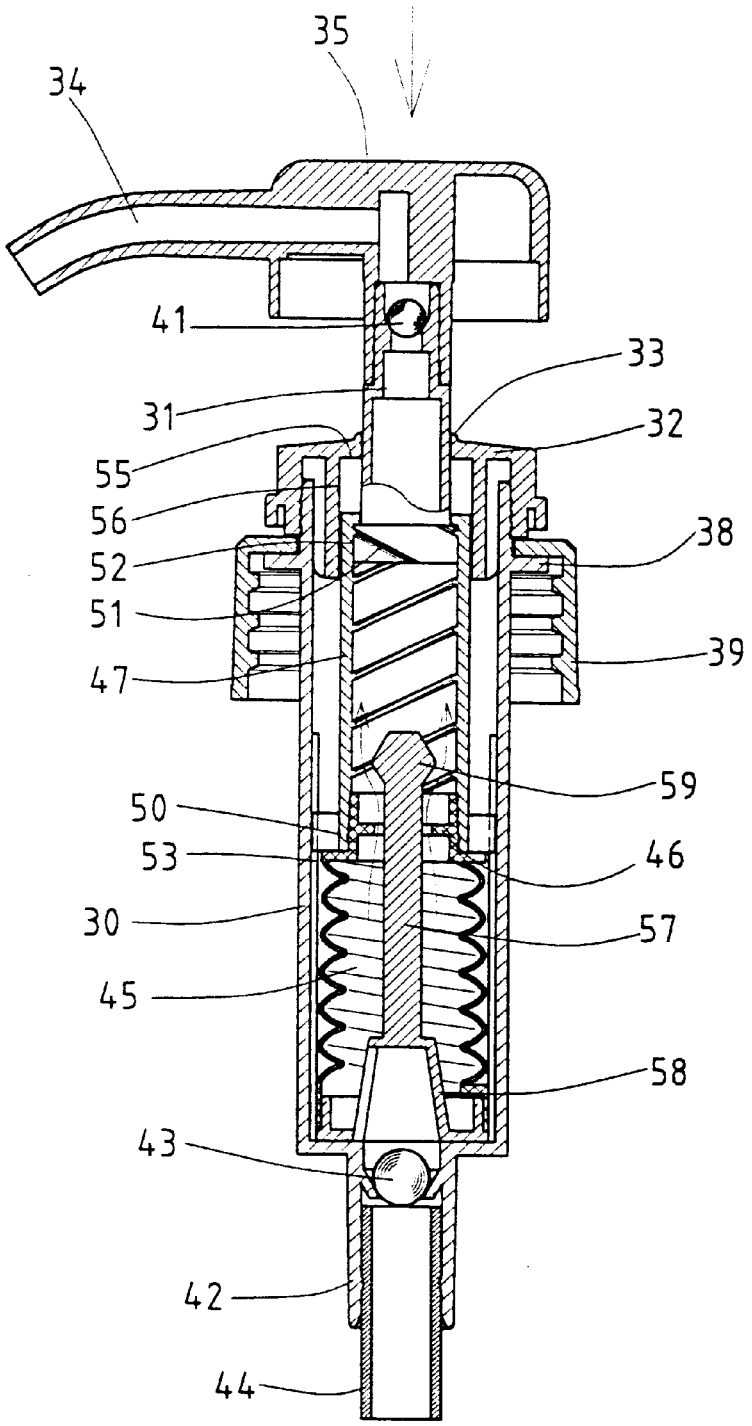
FIG. 7 shows a longitudinal sectional view of the emulsion dispenser of the present invention at work.
Figure 8:
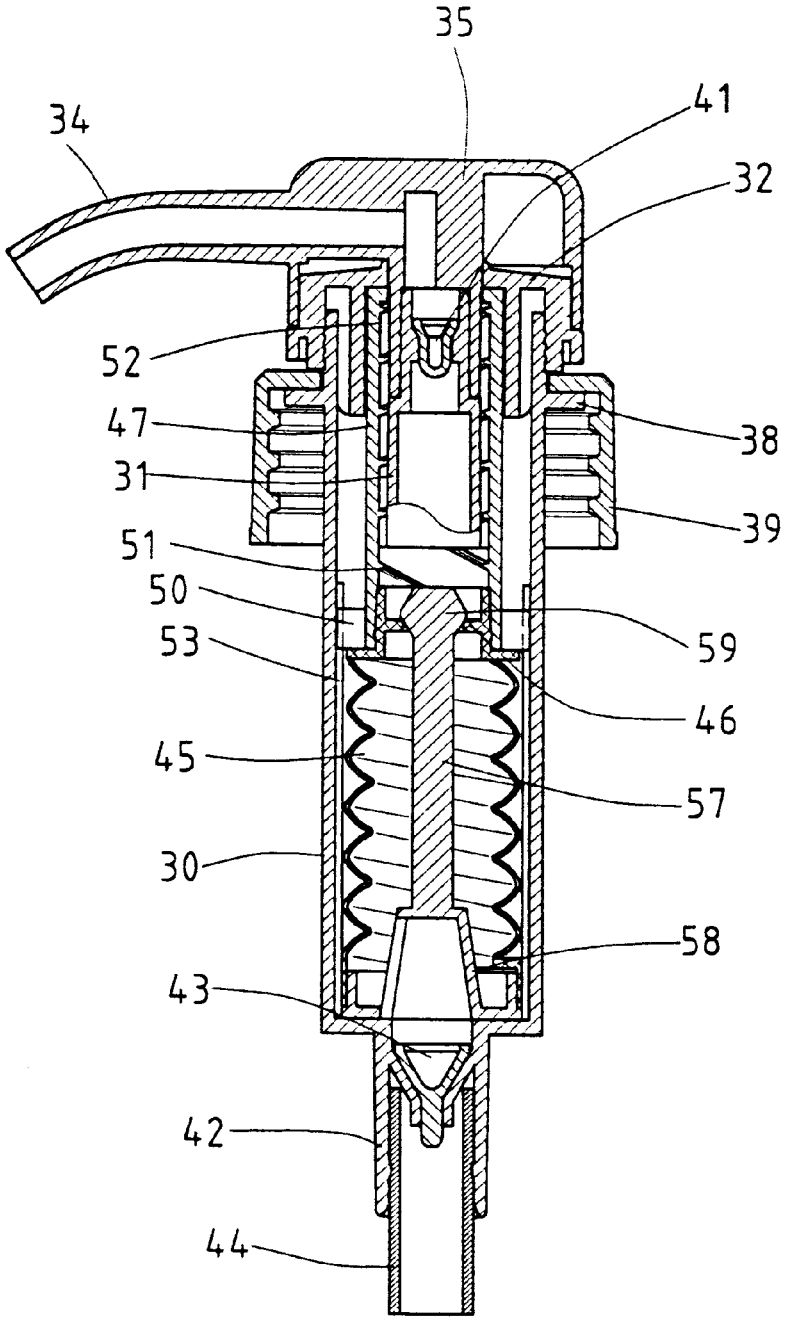
FIG. 8 shows a longitudinal sectional schematic view of the present invention.

As shown in FIGS. 3–11, an emulsion dispenser embodied in the present invention comprises a housing 30, an engagement cap 39, a plunger 31, an up valve 41, a down valve 43, and a plastic spring 45.

The housing 30 is provided at the top end with a collar cap 32 which is provided with a through hole 33. The housing 30 is further provided in proximity of the top end with a screw cap 38. The housing 30 is provided at the bottom end with a bottom tube 42 and a dip tube 44 in contact with the emulsion held in a container.

The engagement cap 39 is disposed between the collar cap 32 and the screw cap 38 of the housing 30 for engaging the housing 30 with the top end of the emulsion container (not shown in the drawings).

The plunger 31 is disposed in the housing 30 such that a top end of the plunger 31 juts out of the collar cap 32 via the through hole 33 of the collar cap 32 so as to fasten to an actuator 35 which is provided with a dispensing tube 34.

The up value 41 and down valve 43 are disposed respectively in the upper segment of the plunger 31 and the bottom tube 42 of the housing 30.

Figure 9:
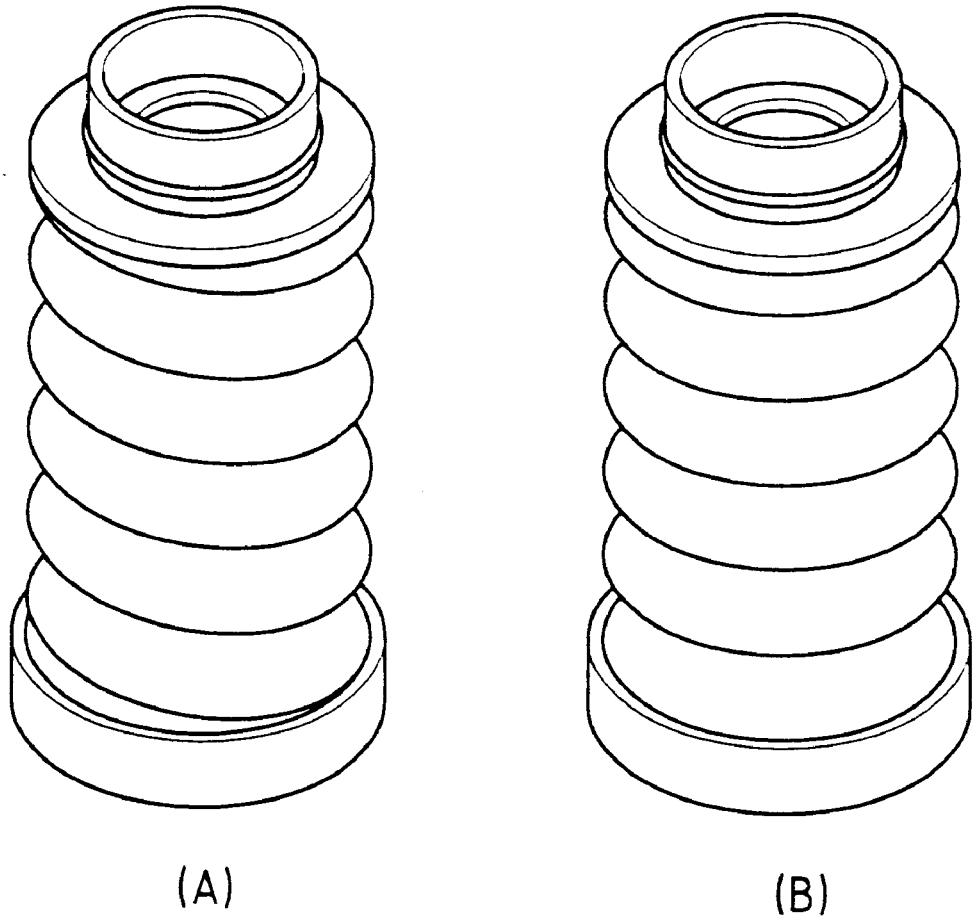
FIG. 9 shows a perspective view of a plastic spring of the present invention.
Figure 10:
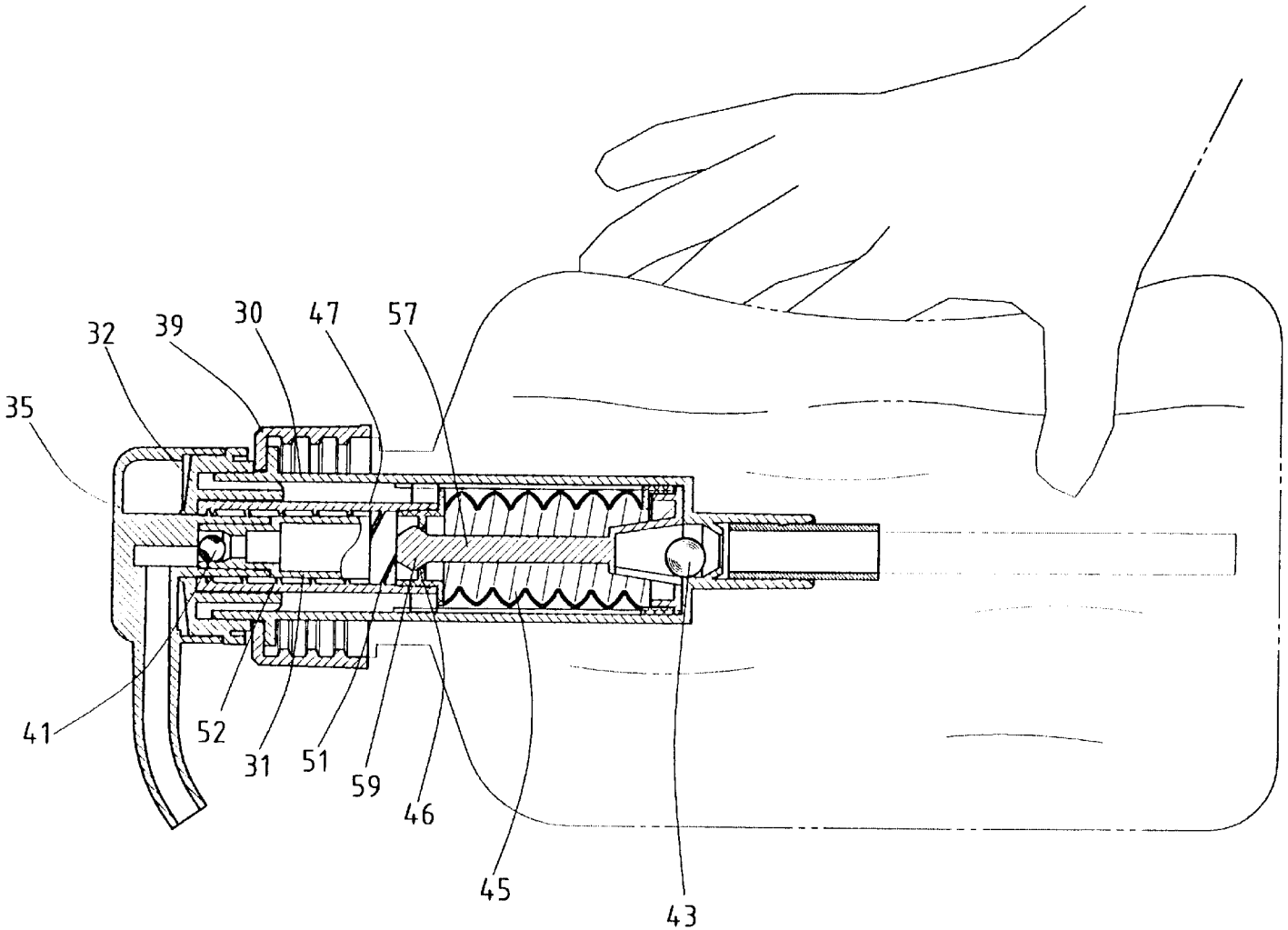
FIG. 10 shows a schematic view of leakproof effect of the present invention.
Figure 11:
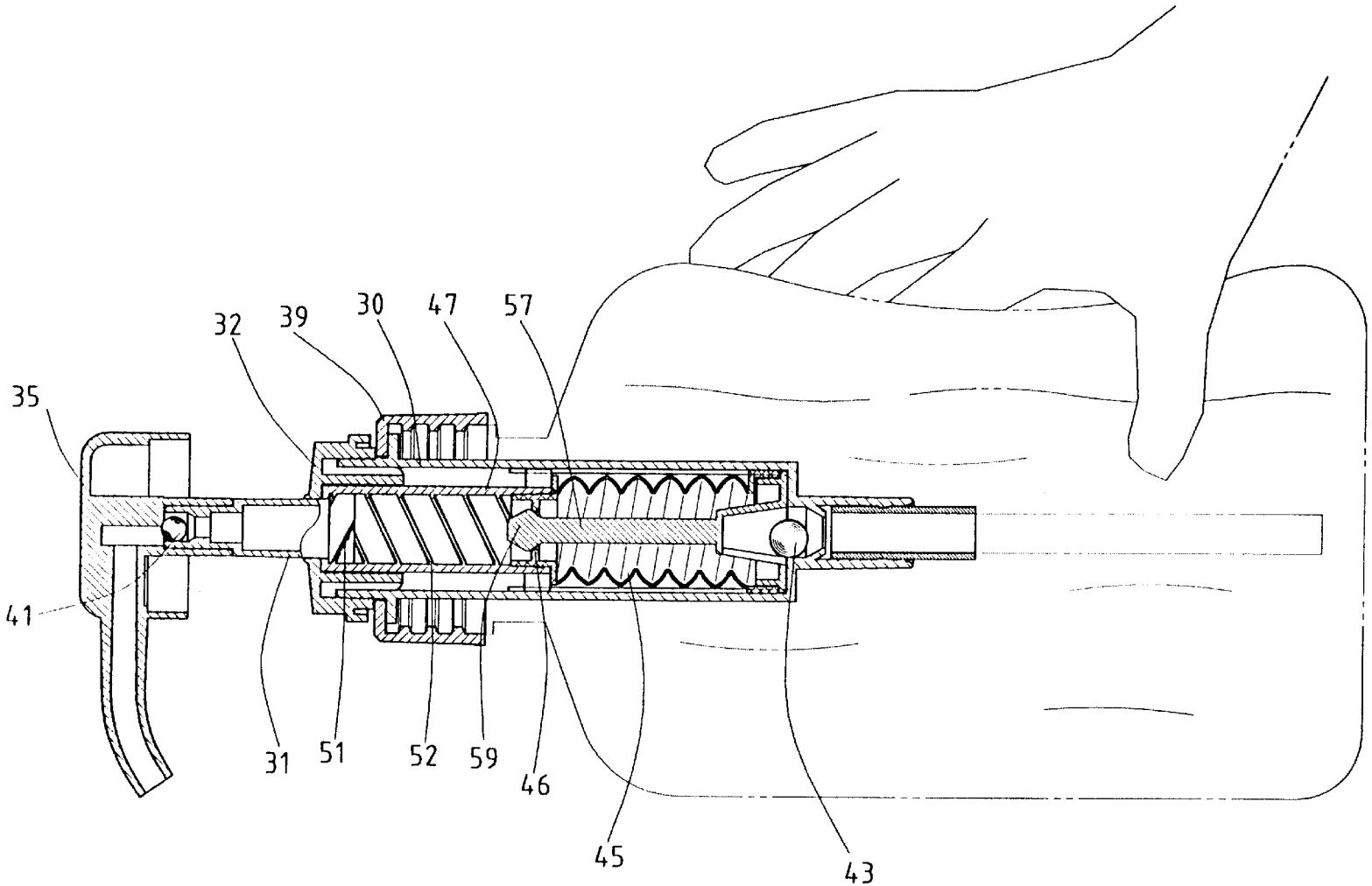
FIG. 11 shows a schematic view of leakproof effect of the present invention ready to dispense.
Figure 12:
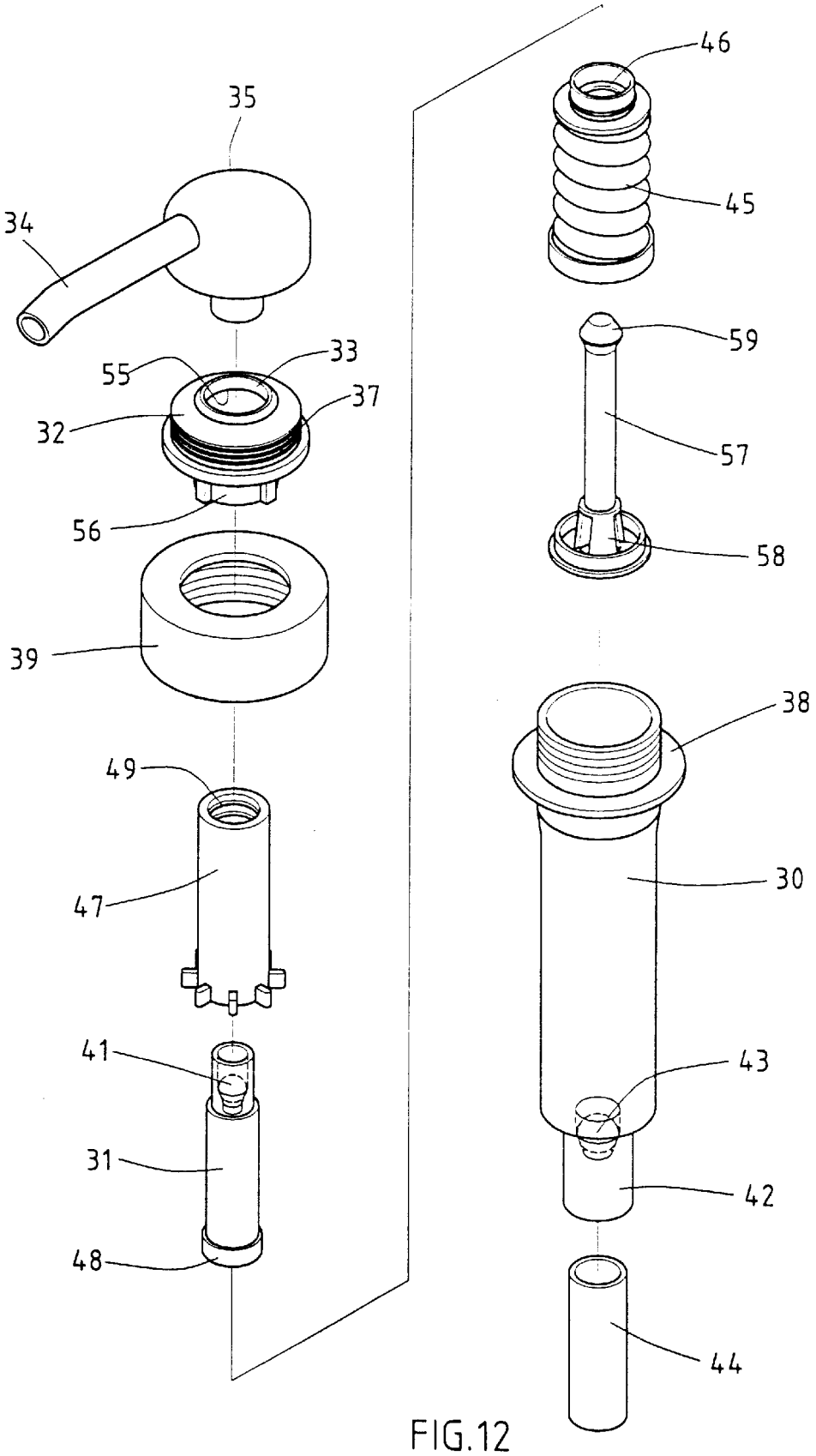
FIG. 12 shows an exploded view of another preferred embodiment of the present invention.
Figure 13:
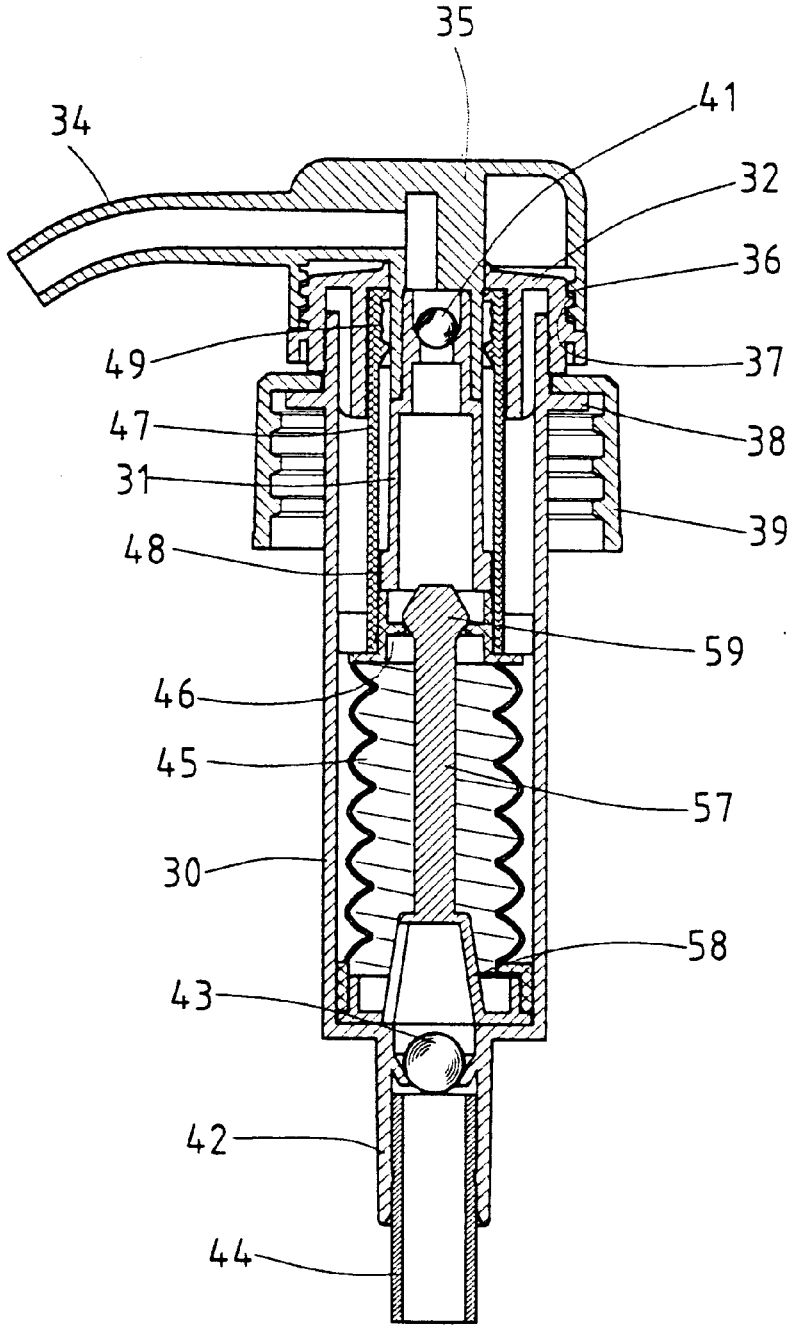
FIG. 13 shows a longitudinal sectional view of the another preferred embodiment of the present invention.
Figure 14:
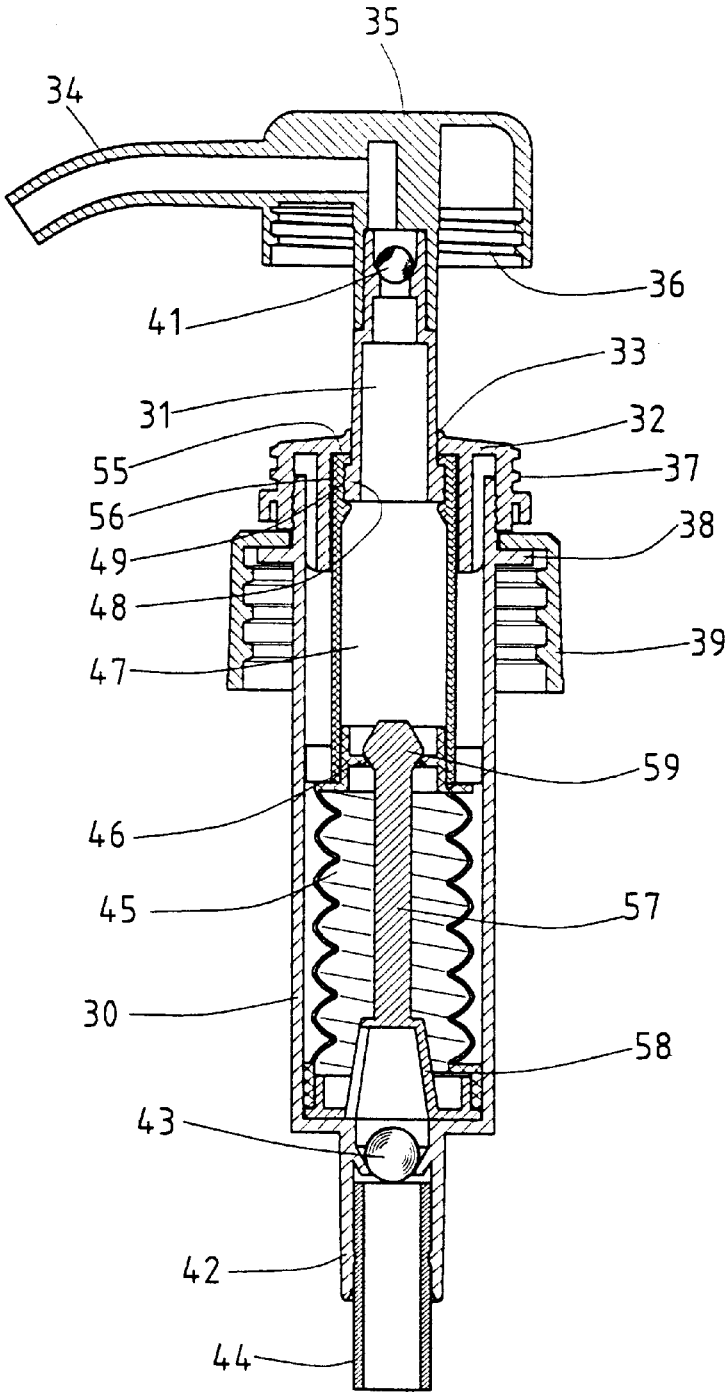
FIG. 14 shows a longitudinal sectional view of the another preferred embodiment of the present invention on standby.
Figure 15:
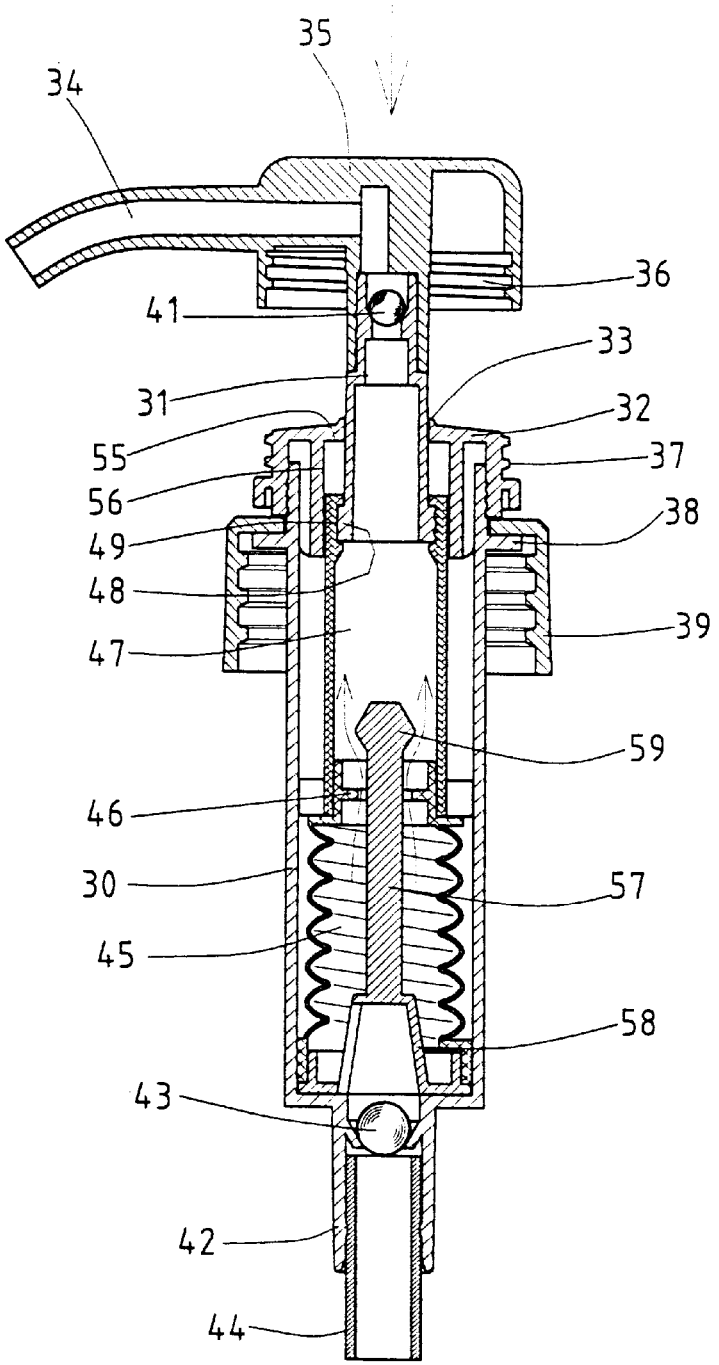
FIG. 15 shows a longitudinal sectional view of the another preferred embodiment of the present invention at work.

The plastic spring 45 is disposed in the housing 30 such that one end of the plastic spring 45 urges the bottom end of the plunger 31, and that other end of the plastic spring 45 urges the inner bottom wall of the housing 30. The plastic spring 45 may be of a spiral tube, as shown in FIG. 9.

The plunger 31 is provided at the bottom end with an outer threaded portion 51 and is fitted into a connect stem 47 such that the outer threaded portion 51 is engaged with an inner threaded portion 52 of the connect stem 47. When the plunger 31 is jutted out of the connect stem 47, the dispenser is ready to dispense the emulsion.

The collar cap 32 is provided with a guide tube 56 extending therefrom and having a flange 55. The guide tube 56 is used to guide the connect stem 47 in motion. Located between the outer wall of the connect stem 47 and the guide tube 56 of the collar cap 32 is a stop portion 53 to prevent the connect stem 47 from turning along with the plunger 31.

The bottom end of the housing 30 is provided with a rod seat 58 having an seat stem 57 and an enlarged end 59 extending from the seat stem 57 such that the enlarged end 59 is put through a stop edge 46 of the top end of the plastic spring 45. The stop edge 46 and the enlarged end 59 form a leakproof device to prevent the escape of the emulsion when the emulsion container is inadvertently turned upside down.

As shown in FIGS. 12–15, an emulsion dispenser of another preferred embodiment of the present invention comprises component parts which are described hereinafter.

A housing 30 is provided at the top end with a collar cap 32 which is provided with a through hole 33. The housing 30 is provided in the outer wall of proximity of the top end thereof with a screw cap 38. The housing 30 is provided at the bottom end with a bottom tube 42 and a dip tube 44 extending from the bottom tube 42 to make contact with the emulsion held in the container to which the dispenser of the present invention is attached.

An engagement cap 39 is disposed between the collar cap 32 and the screw cap 38 of the housing 30 for engaging the housing 30 with an emulsion container (not shown in the drawings).

A plunger 31 is disposed in the housing 30 such that a top end of the plunger 31 is jutted out of the collar cap 32 via the through hole 33 of the collar cap 32, so as to fasten with a actuator 35 which is provided with a dispensing tube 34. The actuator 35 and the collar cap 32 are joined together by means of threads 36 and 37.

An up valve 41 is disposed in the upper segment of the plunger 31. A down valve 43 is disposed in the bottom tube 42 of the housing 30.

A plastic spring 45 is disposed in the housing 30 such that the plastic spring 45 is located between the plunger 31 and the bottom of the housing 30.

The housing 30 is provided with a connect stem 47 into which the plunger 31 is fitted such that the plunger 31 and the connect stem 47 are located by means of retaining projection 48 and retaining slot 49. The actuator 35 and the collar cap 32 are engaged by means of threads 36 and 37. As the threads 36 and 37 are disengaged, the dispenser is ready to dispense the emulsion held in the container. The plunger 31 and the connect stem 47 are located.

The plastic spring 45 and other component parts of the present invention can be recycled together.

We claim:

1. An emulsion dispenser comprising:

a housing comprised of, at a top end, a collar cap which is in turn comprised of a through hole, said housing further comprising, in proximity of the top end thereof, a screw cap, and at a bottom end, a bottom tube and a dip tube extending from said bottom tube to be in contact with the emulsion held in a container;

an engagement cap disposed between said collar cap and said screw cap of said housing for engaging said housing with the container;

a plunger disposed in said housing such that a top end of said plunger juts out of said collar cap via said through hole of said collar cap so as to fasten to an actuator, said actuator comprised of an emulsion dispensing tube;

an up valve disposed in an upper segment of said plunger, a down valve disposed in said bottom tube of said housing;

a plastic spring disposed in said housing and located between said plunger and the bottom of said housing;

said plunger being comprised of an outer threaded portion and is fitted into a connect stem such that said outer threaded portion is engaged with an inner threaded portion of said connect stem, said dispenser being ready to dispense the emulsion at such time when said plunger juts out of said connect stem.

2. The emulsion dispenser as defined in claim 1, wherein said collar cap is comprised of a guide tube extending therefrom and comprising a flange.

3. The emulsion dispenser as defined in claim 2, wherein said connect stem and said guide tube of said collar cap is comprised of, therebetween, a stop portion to prevent said connect stem from turning along with said plunger.

4. The emulsion dispenser as defined in claim 1, wherein said plastic spring is of a spiral construction.

5. The emulsion dispenser as defined in claim 1, wherein said housing is comprised of, at the bottom end, a rod seat comprising an seat stem and an enlarged end extending from said seat stem such that said enlarged end is put through a stop edge of the top end of said plastic spring whereby said stop edge and said enlarged end form a leakproof device to avert the escape of the emulsion when the container is inadvertently turned upside down.

6. An emulsion dispenser comprising:

a housing comprising, at a top end, a top cap which is comprised of a through hole, said housing comprising, in an outer wall of proximity of the top end thereof, a screw cap, said housing being comprised of, at a bottom end, a bottom tube and a dip tube extending from said bottom tube to be in contact with the emulsion held in a container;

an engagement cap disposed between said collar cap and said screw cap of said housing for engaging said housing with the container;

a plunger disposed in said housing such that a top end of said plunger juts out of said collar cap via said through hole of said collar cap so as to fasten to an actuator which is comprised of an emulsion-dispensing tube;

an up valve disposed in the upper segment of said plunger, and a down valve disposed in said bottom tube of said housing; and a plastic spring disposed in said housing such that said plastic spring is located between said plunger and the bottom of said housing;

wherein said housing is comprised of a connect stem into which said plunger is fitted such that said plunger and said connect stem are located by a retaining projection and a retaining slot;

wherein said actuator and said collar cap are engaged by threads such that said dispenser is ready to dispense the emulsion from the container at such time when said threads are disengaged.

* * * * *